United States Patent [19]

Biller et al.

[11] 4,045,758

[45] Aug. 30, 1977

[54] VALVE ARRANGEMENT FOR HIGH VOLTAGE FUSE

[75] Inventors: Bruce A. Biller, Chicago; Henry W. Scherer, Mount Prospect, both of Ill.

[73] Assignee: S&C Electric Company, Chicago, Ill.

[21] Appl. No.: 741,024

[22] Filed: Nov. 11, 1976

[51] Int. Cl.[2] ..... H01H 85/20

[52] U.S. Cl. ..... 337/186; 337/248; 337/414

[58] Field of Search ..... 335/186, 203, 248, 249, 335/250, 414, 205

[56] References Cited

U.S. PATENT DOCUMENTS

| | | | |
|---|---|---|---|
| 2,166,174 | 7/1939 | Popp | 337/250 X |
| 2,168,153 | 8/1939 | Brown | 337/248 X |

*Primary Examiner*—George Harris

*Attorney, Agent, or Firm*—Kirkland & Ellis

[57] ABSTRACT

A valve arrangement for high voltage fuses permits the atmosphere to be vented into the interior of the fuse when the atmospheric pressure is greater than the interior pressure of the fuse, but restricts venting back out of the fuse when the interior pressure of the fuse is greater than atmospheric pressure thereby tending to maintain a greater than atmospheric pressure on the inside of the fuse to assist in preventing moisture from entering the fuse. The valve arrangement also enhances fuse operation. During the interruption of relatively low current, it functions as a check valve and tends to assist in increasing the internal pressure within the fuse thereby tending to accelerate contact separation. However, at higher current levels the valve arrangement ruptures, releasing the arc gases so that there is not an adverse effect on fuse operation.

14 Claims, 4 Drawing Figures

VALVE ARRANGEMENT FOR HIGH VOLTAGE FUSE

BACKGROUND OF THE INVENTION

1. Field of the Invention

The present invention relates to valve arrangements for high voltage fuses.

2. Description of the Prior Art

High voltage fuses and particularly high voltage expulsion type fuses are well known to the art. For example, U.S. Pat. No. 3,267,235 — Barta, 3,176,100 — Barta, 3,575,683 — Fahnoe all disclose various configurations of high voltage expulsion type fuses. Such fuses are often utilized outdoors on utility poles, and thus, are directly exposed to adverse weather conditions including rain, sleet, hail, and snow. Accordingly, such high voltage expulsion type fuses have typically been hermetically sealed to prevent the admittance of moisture into the interior of the fuse. It has been discovered that moisture on the inside of the fuse typically results in deterioration and corrosion of the internal components of the fuse. Thus, proper fuse operation can be affected. However, it has also been discovered that despite the best attempts to provide a reliable hermetically sealed fuse which will maintain its sealed relationship even after years of use, leaks often occur as a result of rough handling, thermal expansion of various dissimilar parts of the fuse, corrosion and exposure to adverse weather conditions. Once even the smallest of leaks develops in the fuse, a phenomenon called "pumping" results which causes the ingress of moisture into the interior of the fuse. Pumping results because of the well known physical relationship of pressure, volume, and temperature. Since the fuse has a constant interior volume, any change in the temperature of the air in that volume correspondingly results in a change in the pressure in the interior of the fuse. Thus, when the temperature of the fuse drops rapidly such as during a rainstorm, the interior pressure of the fuse tends to drop rapidly so that the interior pressure of the fuse may become less than atmospheric pressure thereby causing any moisture on the surface of the fuse to be sucked through any minor defect around the various hermetic seals of the fuse. Once moisture is pumped into the fuse, it is usually retained in the fuse for an extended period of time because there is no atmospheric venting to dry the interior of the fuse. Consequently, after a period of time there may be deterioration of the interior components of the fuse. Accordingly, it has been discovered that it would be an advantageous advance in the art of circuit interruption to provide a valve arrangement for a high voltage fuse which permits substantial atmospheric venting to the interior of the fuse when the atmospheric pressure is greater than the pressure on the interior of the fuse so that a pressure less than atmospheric pressure is never obtained in the fuse, while subsantially checking the exhaust of gases during interruption of lower currents.

BRIEF DESCRIPTION OF THE INVENTION

The present invention relates to valve arrangements for atmospheric venting to the interior of a high voltage fuse comprising wall means covering an open end of the fuse having at least one opening therethrough communicating between the interior of the fuse and the atmosphere. A valve means is provided which cooperates with the wall means to seal the at least one opening when the pressure within the interior of the fuse exceeds atmospheric pressure and to open the at least one opening in the wall means to permit atmospheric venting to the interior of the fuse when the pressure within the interior of the fuse is less than atmospheric pressure. The wall means can take various shapes and configurations and typically is threaded into the bottom of the fuse. The valve means can comprise a flat flexible disk and may be fabricated from polyethylene teraphthalate.

Thus, it is principal object of the present invention to provide a valve arrangement for a high voltage fuse which permits atmospheric venting to the interior of the fuse when atmospheric pressure is greater than the pressure on the inside of the fuse, but which restricts venting when the pressure on the inside of the fuse is greater than atmospheric pressure.

Yet another object of the present invention is to provide a valve arrangement for a high voltage fuse which enhances fuse operation during low current interruption but does not interfere with fuse operation during high current interruption.

These and other objects, advantages and features will hereinafter appear, and for the purposes of illustration, but not for limitation, exemplary embodiments of the present invention are illustrated in the attached drawings.

DETAILED DESCRIPTION OF THE PREFERRED EMBODIMENT

Figure 1:
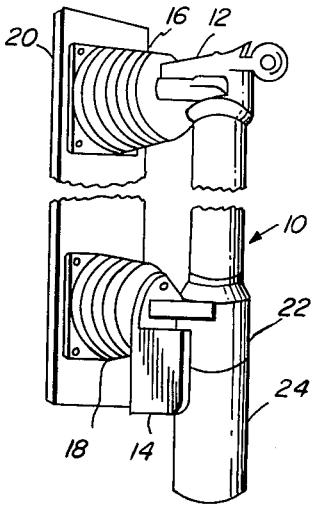
FIG. 1 is a side elevational view of a typical high voltage fuse arrangement representative of the type in which the present invention may be utilized.

With reference to FIG. 1, a typical high voltage fuse 10 is illustrated mounted between an upper terminal 12 and a lower terminal 14. Terminals 12 and 14 are supported by insulators 16 and 18 which are mounted on a base member 20 which may be fastened to a utility pole or other such supporting structure. Fuse 10 has a metallic end ferrule 22 which is shown having an exhaust control device 24 mounted thereon. Exhaust control device 24 may take the form of any conventional exhaust control device such as the exhaust control device disclosed in U.S. Pat. No. 3,575,683 — Fahnoe or the exhaust control device illustrated in U.S. Pat. No. 3,965,452 — Chabala et al.

Figure 2:
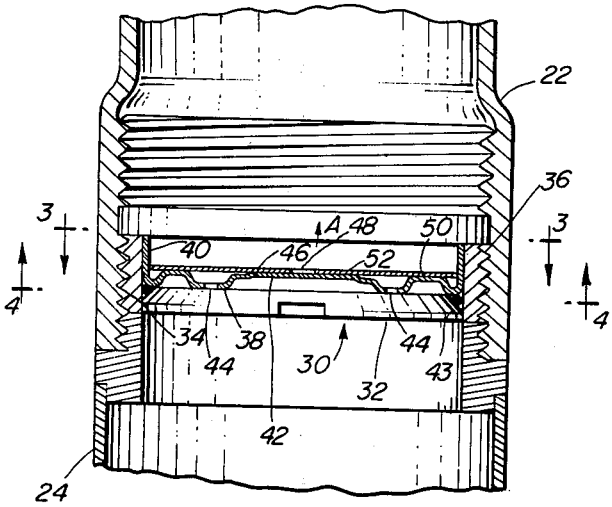
FIG. 2 is a cross-sectional partially fragmentary view of the end of a high voltage fuse showing one embodiment of the present invention mounted on the fuse.

With reference to FIG. 2, metallic end ferrule 22 has a threaded interior into which valve arrangement 30 is screwed. Valve arrangement 30 comprises an annular ring member 32 that has threads 34 formed on the exterior surface thereof which engage threads 36 formed on the interior of ferrule 22. Positioned within the hollow interior of annular ring member 32 is a plate member 38 which has an annular flange portion 40 dimensioned to engage the interior surface of ring member 32. Plate member 38 is soldered in position by solder 43 to hold plate member 38 in the position illustrated in FIG. 3. Plate member 38 also comprises a circular wall portion 42 which is joined to the annular flange 40 and extends entirely across the hollow opening through annular ring member 32 thereby closing off the end of the fuse 10 except for four small openings 44 through the wall portion 42.

Positioned immediately above wall portion 42 is a flat flexible disk 46 having a small oblong or rectangular shaped opening 48 at approximately its center. Disk 46 can be formed in a circular or non-circular shape from any strong resilient material which retains its flat shape regardless of humidity and temperature changes. Preferably, flat disk 46 is fabricated from a film of polyethylene teraphthalate commercially available under the trademark "Mylar." Disk 46 is secured to wall portion 42 along flat surface 50 by a suitable adhesive.

Fuse 10 is constructed so that all joints are hermetically sealed to prevent the admission of water. Thus, the only entrance into fuse 10 is through openings 44 in plate member 38. Disk 46 normally rests against flat surfaces 50 and 52 of wall portion 42 to provide sealing action. When the pressure on the interior of fuse 10 is less than atmospheric pressure, flexible disk 46 tends to flex upwardly in the direction of arrow A in FIG. 2 allowing the atmospheric air to enter opening 44, flow between flat surface 52 and disk 46 and through opening 48 into the interior of fuse 10. Accordingly, a pressure less than atmospheric pressure will not be maintained inside the fuse. However, if the air on the inside of the fuse tends to increase in volume, for example, as a result of temperature increase, the resultant air pressure tends to cause disk 46 to flex back until it seals against flat surfaces 50 and 52 thereby preventing air from flowing back through opening 48 and openings 44. Thus, while the contact of disk 46 against flat surfaces 50 and 52 may not provide a perfect seal, disk 46 does tend to maintain the pressure within fuse 10 for an extended period of time. Accordingly, a greater than atmospheric pressure is normally tended to be maintained within fuse 10 so that there is no tendency for moisture to be sucked into the interior of fuse 10 through any small leaks that might develop around any of the hermetic seals.

As previously pointed out, previous attempts to provide a wholly hermetically sealed fuse have been somewhat unsatisfactory because of the phenomena called pumping. Pumping results when the interior pressure of the sealed fuse decreases as a result of a temperature change, i.e., such as during a rainstorm, so that the internal pressure is less than atmospheric pressure. This tends to cause any moisture covering any cracks or leaks in the fuse to be sucked into the interior of the fuse. The present valve arrangement 30 helps to reduce the possibility of pumping by rapidly equalizing the internal and external pressure when the exterior atmospheric pressure is greater than the pressure on the inside of the fuse and by also tending to maintain a greater than atmospheric pressure on the inside of the fuse when the atmospheric pressure drops.

Figure 3:
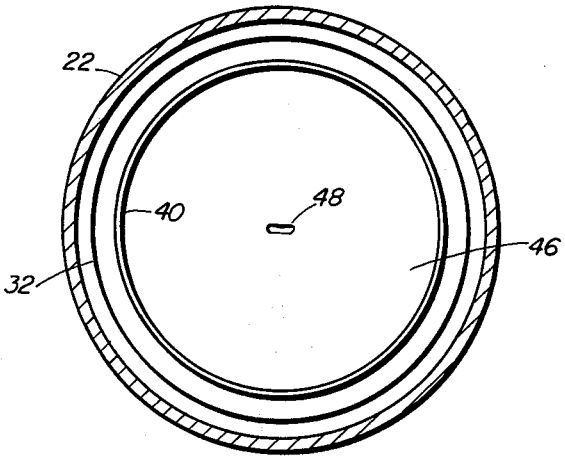
FIG. 3 is a cross-sectional view taken substantially along line 3—3 in FIG. 2.
Figure 4:
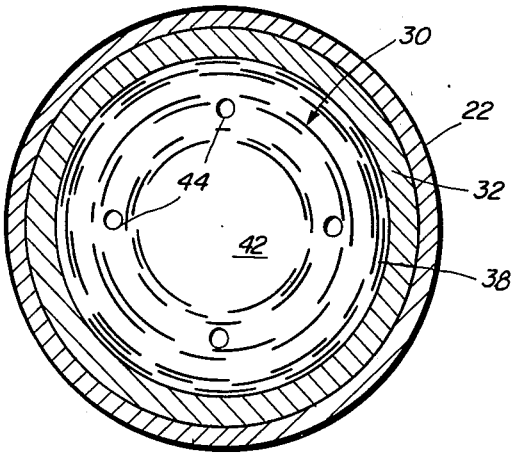
FIG. 4 is a cross-sectional view taken substantially along line 4—4 in FIG. 2.

The opening 48 in disk 46 in FIG. 2 and 3 is formed in a oblong or rectangular shape to limit the possibility of opening 48 being accidentially clogged by airborne particles. A round opening tends to be clogged more easily by such particles since such particulate matter is usually relatively symmetrical in shape. Thus, the rectangular or oblong opening makes it more difficult for such particulate matter to clog the opening.

The present invention also provides other advantages in enhancing the operation of fuse 10. When an expulsion fuse such as fuse 10 operates, pressure increases within the fuse as a result of the heat generated by arcing between separating contacts and as a result of the gases created when the arc is exposed to an arc extinguishing material that is typically provided in such fuses. Such fuses typically have a wide range of current interrupting capabilities from currents of less than 100 amperes to tens of thousands of amperes. If a fuse is permitted to vent freely, the fuse design which will function successfully at the lowest range of currents is inadequate for currents at higher current range, and vice versa. It is desirable to restrict fuse venting at the beginning of fuse operation or during low current operation and to permit free venting of the fuse when the fuse is interrupting high currents. At lower current ranges, the increased internal pressure by restricted venting tends to accelerate contact separation thereby aiding in circuit interruption. However, at higher levels, the pressure and temperature increases very rapidly, and it is desirable to relieve the pressure so that the entire fuse does not fracture or explode.

When the fuse 10 operates, the rapidly increasing pressure immediately causes disk 46 to seal against flat surfaces 50, and 52 so that venting is restricted. Accordingly, if low currents are being interrupted by fuse 10, the pressure increases rapidly as a result of the sealing action thereby assisting in contact separation and current interruption.

However, if high currents are being interrupted by fuse 10, while the pressure initially builds up within fuse 10 thereby assisting initially in contact separation, the pressure rapidly builds up to the point where wall portion 42 is ruptured allowing the rapid release of the internal pressure of the fuse. Wall member 42 can be fabricated of any metallic material which has a sufficiently low tensile strength so that it can be blown out of the ring member 32 when a predetermined high pressure occurs in fuse 10. Typically, wall portion 42 is fabricated from thin copper, and the thickness of the copper can be adjusted to allow for rupture at predetermined internal pressures. Alternatively, wall portion 42 could be fabricated from plastic material molded to obtain the required strength to achieve the desired pressure response.

It will be apparent to one skilled in the art that various changes, alterations, or modifications may be made in the preferred embodiments illustrated and described herein without departing from the spirit and scope of the present invention as defined in the appended claims.

We claim:

1. A valve arrangement for permitting one way atmospheric venting to the interior of a high voltage fuse comprising:

wall means for closing an open end of the fuse, said wall means having at least one opening therethrough communicating between the interior of the fuse and the atmosphere;

valve means cooperating with said wall means for sealing said at least one opening when the pressure within the interior of the fuse exceeds atmospheric pressure, and for opening said at least one opening in said wall means for permitting atmospheric venting to the interior of the fuse when the pressure within the interior of the fuse is less than atmospheric pressure.

2. A valve arrangement, as claimed in claim 1, wherein:

said wall means comprises an annular ring having an annular opening, said ring having threads thereon threaded into the open fuse end, said annular ring having a plate member sealed across its annular opening, said plate member having said at least one opening therethrough, and said valve means comprises a flat flexible disk having an opening therethrough, said disk being positioned on the interior side of said plate member overlying the at least one opening in said plate member so that the opening in said disk does not align with the at least one opening in said plate member.

3. A valve arrangement, as claimed in claim 2, wherein the opening in said disk is essentially oblong in shape so that the possibility of clogging is reduced.

4. A valve arrangement, as claimed in claim 2, wherein said plate member is formed of a metal sheet of sufficient thickness to avoid rupture during low current interruption so that current interruption is enhanced but to permit rupture at high current interruption to release arc gases.

5. A valve arrangement, as claimed in claim 2, wherein said disk is fabricated of polyethylene teraphthalate.

6. A valve arrangement, as claimed in claim 1, wherein:

said wall means comprises a threaded member screwed into the open end of the fuse, said threaded member closing the end of the fuse except for at least one opening therethrough; and said valve means comprises a flat flexible disk positioned on the interior side of said threaded member overlying said at least one opening in said threaded member.

7. A valve arrangement, as claimed in claim 6 wherein said disk has an opening therein positioned so that the opening in said disk does not align with said at least one opening in said threaded member.

8. A valve arrangement, as claimed in claim 7, wherein the opening in said disk is essentially oblong in shape so that the possibility of clogging is reduced.

9. A valve arrangement, as claimed in claim 6, wherein said threaded member enhances current interruption by remaining intact during low current faults thereby closing the end of the fuse, but rupturing to release arc gases during high current interruption.

10. A valve arrangement, as claimed in claim 6, wherein said disk is fabricated of polyethylene teraphthalate.

11. In a high voltage fuse, the fuse being generally sealed, an improvement comprising:

venting means for allowing atmospheric venting into the fuse; and valve means cooperating with said venting means for preventing said venting means from allowing the atmosphere to enter the fuse when the pressure within the interior of the fuse exceeds atmospheric pressure, and for allowing atmospheric venting through said venting means when the pressure within the fuse is less than atmospheric pressure.

12. An improvement, as claimed in claim 11, wherein said valve means comprises a flat flexible disk having a small oblong opening therethrough.

13. An improvement, as claimed in claim 12, wherein said disk is fabricated from polyethylene teraphthalate.

14. An improvement, as claimed in claim 11, wherein said venting means is dimensioned to remain intact during low current interruption by the fuse but to rupture during high current interruption by the fuse thereby permitting unrestricted venting to enhance fuse operation.

* * * * *

UNITED STATES PATENT OFFICE

CERTIFICATE OF CORRECTION

PATENT NO. : 4,045,758

DATED : August 30, 1977

INVENTOR(S) : Bruce A. Biller, Henry W. Scherer

It is certified that error appears in the above-identified patent and that said Letters Patent are hereby corrected as shown below:

Column 2, line 65, "FIG. 3" should read --FIG. 2--.

Column 3, line 22, "opening" should read --openings--.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*